United States Patent [19]

Röck et al.

[11] Patent Number: 4,589,710

[45] Date of Patent: May 20, 1986

[54] FASTENING DEVICE

[75] Inventors: Erich Röck; Josef Brunner, both of Höchst, Austria

[73] Assignee: Julius Blum Gesellschaft m.b.H., Höchst, Austria

[21] Appl. No.: 601,846

[22] Filed: Apr. 19, 1984

[30] Foreign Application Priority Data

Jun. 10, 1983 [AT] Austria ..... 2124/83

[51] Int. Cl.[4] ..... A47B 88/00

[52] U.S. Cl. ..... 312/330 R; 312/247; 312/334; 312/140; 248/188.2; 248/243

[58] Field of Search ..... 312/330 R, 334, 247, 312/111, 140; 248/188.2, 243

[56] References Cited

U.S. PATENT DOCUMENTS

| | | | |
|---|---|---|---|
| 1,055,522 | 3/1913 | Cumming | 248/243 |
| 1,254,094 | 1/1918 | Vogt | 248/243 |
| 2,350,155 | 5/1944 | Deal | 248/188.2 |
| 2,702,732 | 2/1955 | McCarran | 312/111 |
| 2,883,137 | 4/1959 | Weber | 248/243 |
| 2,928,512 | 3/1960 | Slater et al. | 248/243 |
| 2,979,857 | 4/1961 | Longbotham | 248/188.2 |
| 3,186,670 | 6/1965 | Perl | 248/188.2 |
| 3,610,720 | 10/1971 | Hosmer | 312/330 R |
| 3,752,553 | 8/1973 | Bildahl et al. | 312/330 R |
| 4,090,753 | 5/1978 | Rock et al. | 312/330 R |

FOREIGN PATENT DOCUMENTS

| | | | |
|---|---|---|---|
| 2042328 | 9/1980 | United Kingdom | 312/330 R |

*Primary Examiner*—Victor N. Sakran

*Attorney, Agent, or Firm*—Wenderoth, Lind & Ponack

[57] ABSTRACT

A device fastens front plates of drawers such that adjustment of the position of the front plate is possible. At each side of the drawer is provided a supporting member engaged with a holding member which is fastened to the front plate. To facilitate lateral adjustment of the front plate, the lower side of the holding member at only one side of the drawer is provided with an adjusting screw for the lateral adjustment of the front plate, while the holding member on the other side is laterally free and has a stop flap for limiting the vertical adjustment of the front plate.

9 Claims, 3 Drawing Figures

FASTENING DEVICE

FIELD AND BACKGROUND OF THE INVENTION

The invention relates to a fastening device for adjustable front plates of extractable furniture parts, in particular for drawers, a supporting member being fastened to each side of the furniture part, in particular to the guide rails of a pull-out guide assembly, a holding member being fastened at each side of the front plate, and the holding members being attach to the supporting members by means of screws. The holding members and the supporting members are interlocked with one another by means of screws or the like at one upper and one lower bearing point, or are slideable into one another. An adjusting member provides for vertical adjustment of the holding members, and an adjustable stop provides the position of the front plate at least in the vertical. The axes of the screws holding the holding members at the supporting members are aligned parallel to the front plate.

DESCRIPTION OF THE PRIOR ART

It is the function of such fastening devices, which are widely used in modern furniture construction, to ensure fastening of the front plate of a drawer or of a pull-out shelf while permitting adjustment and readjustment of the front plate in three dimensions, if possible, so that in the case of greater tolerances, which may be caused during the mounting of the guide rail, the front plate can be symmetrically and vertically aligned.

In addition to such possibilities of adjustment, this type of fitting should permit rapid mounting and fixing of the front plate to the parts associated with the drawer, and fixing and adjusting means should be easily accessible.

SUMMARY OF THE INVENTION

The fastening device according to the invention advantageously first provides the possibility of fastening the front plate rapidly to the drawer, and second of adapting the fastening device in such a way that a zero position is set for the front plate. This means that it will generally be sufficient to engage the front plate only in the supporting members on the side of the drawer and then to fasten them quickly. Only if an adjustment of the front plate becomes necessary are the required adjusting operations, which otherwise are not necessary, made.

It is the object of the invention to facilitate the adjustment of such a fastening device.

According to the invention this is achieved by providing at the lower side of only one of the holding members an adjusting screw for the lateral adjustment of the front plate, which adjusting screw is immovably held in the respective supporting member. The holding member at the other side of the front plate is laterally free at the lower side and preferably has a stop flap for limiting the vertical adjustment of the front plate.

The advantage of the design according to the invention compared to known fastening devices is that the adjustment of the lateral alignment of the front plate must be made at one side only of the drawer. At the other side, the holding member is resiliently drawn or guided to the proper position.

It is advantageously provided that the upper screws hold the holding members at pivots which are mounted at the supporting members about an axle extending parallel to the front plate, an adjusting screw being provided between each supporting member and respective pivot.

One embodiment of the invention provides that such adjusting screw is mounted in a female thread in the holding member, extends through a slot in the pivot whose width is slightly greater than the external diameter of the screw, and through a slot in the supporting member which is wider than the slot in the pivot.

BRIEF DESCRIPTION OF THE DRAWINGS

Below an embodiment of the invention will be described with reference to the drawings, in which.

Figure 1:
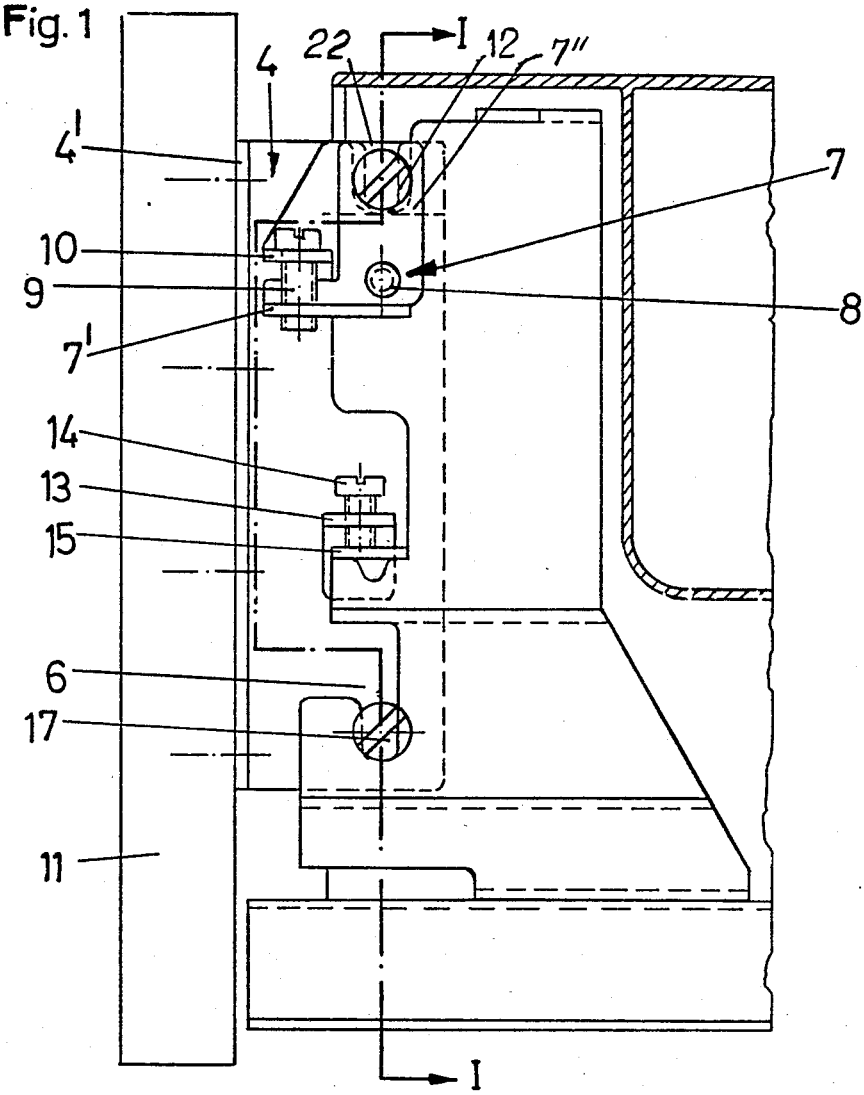
FIG. 1 is a side view of a fastening device according to the invention.
Figure 2:
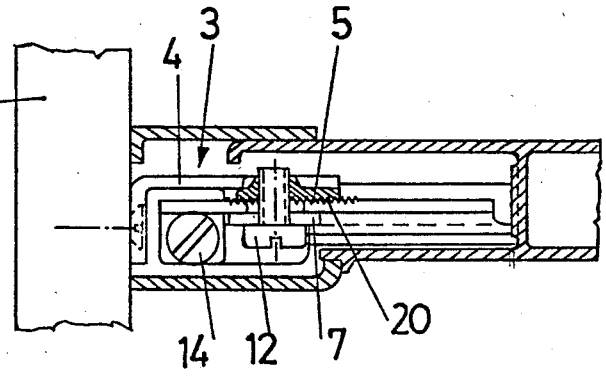
FIG. 2 is a top view of the fastening device according to the invention.
Figure 3:
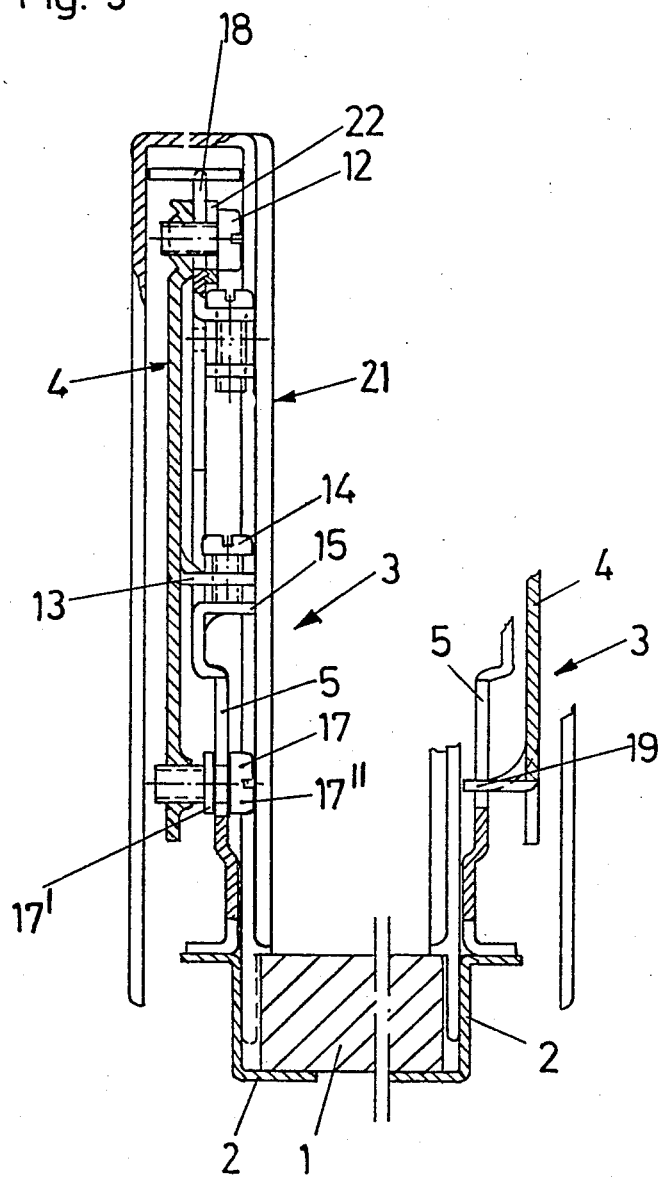
FIG. 3 is a sectional view along line I—I of FIG. 1.

In the drawings, only one side of a fastening device is fully shown. The second side is only shown in the region which is differently designed (FIG. 3).

DETAILED DESCRIPTION OF THE PREFERRED EMBODIMENT

As can be seen in the drawings, the pull-out member, which is has at opposite sides thereof pull-out shelf 1 in the present case, has a guide rails 2 each of which has a Z-shaped cross section and carries a fastening device 3 at its front end.

A front plate 11 is fastened to the pull-out shelf 1 by means of the fastening devices 3.

Each fastening device 3 substantially comprises a holding member 4 and a supporting member 5. The supporting member 5 is substantially a lateral support which is aligned in the longitudinal direction of the guide rail 2 and directly fastened to the front end of the guide rail 2. The supporting member 5 is aligned parallel to the side wall of the drawer. The holding member 4 has an angular flange 4' which is parallel to the front plate and to which the front plate 11 is fastened by means of screws or the like.

In the fastening device 3, which is shown in at the left side of FIG. 3, a screw 12 is screwed into the upper side of the holding member 4 and a screw 17 is screwed into the lower side thereof. A horizontal flap 13 is bent out of the center of the holding member 4, flap 13 having a female thread into which is screwed a screw 14 for is screwed vertical adjustment is screwed.

In the mounting position, screw 14 abuts on a horizontal flap 15 which is bent out of the holding member 5. When being pre-mounted, the screw 14 is screwed into the flap 13 such that it projects by a pre-set dimension so that a zero position with regard to vertical location is automatically set when the holding member 4 is fitted onto the supporting member 5.

For mounting the front plate 11, first the two holding members 4 are screwed to the front plate 11 and then the front plate 11 with the holding member 4 is fitted onto the supporting members 5, each upper screw 12 being inserted into a slot 18 in the respective supporting member 5 and into a slot 22 in a respective pivot 7.

The lower screw 17 is fitted into the L-shaped slot or recess 6 in member 5 and is axially immovably supported on member 5 between a flange rim 17' and its head 17''.

As already mentioned, the screw 14 abuts on the flap 15. The holding member on the opposite side of the drawer (shown in FIG. 3 at the right side) is designed like the above-described holding member 4, with the exception of the lower screw 17. Instead of the lower screw 17, there is provided a flap 19 which is bent out of the holding member 4 to form a stop towards the lower, front and rear sides of member 5, but which is free laterally. Due to this design, it is sufficient to adjust the front plate laterally merely by turning the single screw 17 on only one side of the drawer, because the fastening device 3 at the other side of the drawer yields as the respective holding member 4 is resiliently drawn into position.

The pivot 7 is mounted on an axle 8, which may be a rivet, and has two flanges 7' and 7''.

The flange 7' is linked to a flap 10 of the supporting member 5 by means of a screw 9. By turning the screw 9, the pivot 7 is tilted about axle 8.

At the flange 7'', the pivot is provided with slot 22 corresponding to the diameter of the screw 12. The screw 12 is hence laterally held in the pivot 7. When the pivot 7 is tilted, it tilts the screw 12 and the holding member 4, and thus the front plate 11.

The extent of this adjusting possibility is determined by the width of the slot 18 in the supporting member 5.

After adjustment, the screw 12 is tightened and thus clamps the holding member 4, the supporting member 5 and the pivot 7 to one another, thus finally and securely fixing the position of front plate 11.

To improve the fit between the individual parts, a serrations or teeth 20 may be provided.

In the embodiment, the illustrated drawer is shown with one side wall covering 21 which is advantageously of plastic material and which completely covers the fastening device 3.

What is claimed is:

1. In an arrangement for adjustably mounting a front plate on an extractable furniture part, particularly a drawer, said arrangement being of the type including, at each side of the furniture part, a fastening device comprising a supporting member to be mounted on the furniture part, a holding member to be mounted on the front plate, and upper screw means for connecting said holding member to said supporting member and thereby for mounting the front plate on the furniture part, and further including means for adjusting the vertical position of the front plate relative to the furniture part, and means for readjusting the lateral position of the front plate relative to the furniture part, the improvement wherein said lateral adjusting means comprises:

an adjusting screw at a lower portion of only a first said fastening device at one side of the furniture part, said adjusting screw having an axis extending parallel to the plane of the front plate, and said adjusting screw being axially fixed to one of said members of said first fastening device and threaded into the other said member of said first fastening device, whereby rotation of said adjusting screw laterally moves said one member relative to said other member and thus laterally adjusts to position of the front plate relative to the furniture part; and means, at a lower portion of the second said fastening device at the other side of the furniture part, for freely guiding relative lateral movement between said members of said second fastening device.

2. The improvement claimed in claim 1, wherein said adjusting screw is axially fixed to said supporting member of said first fastening device and is threaded into said holding member thereof.

3. The improvement claimed in claim 1, wherein said guiding means comprises a flap extending laterally from said holding member of said second fastening device into a slot in said supporting member thereof.

4. The improvement claimed in claim 3, wherein said slot is defined by front, rear and lower edges, said flap abutting said lower edge to limit relative vertical adjustment of the front plate relative to the furniture part.

5. The improvement claimed in claim 1, wherein said upper screw means comprise respective upper screws having axes extending parallel to the plane of the front plate.

6. The improvement claimed in claim 5, wherein each said fastening device further comprises a pivot member pivoted to the respective said supporting member about an axle extending parallel to the plane of the front plate, and adjusting screw means provided between said pivot member and said supporting member for pivoting said pivot member about said axle.

7. The improvement claimed in claim 6, wherein said upper screw is threaded into said holding member and extends through slots in said pivot member and in said supporting member, said slot in said supporting member being wider than said slot in said pivot member.

8. The improvement claimed in claim 7, wherein said upper screw clamps together said holding, pivot and supporting members.

9. The improvement claimed in claim 6, wherein said adjusting screw means is positioned between said upper screw and the front plate.

* * * * *